US007611257B2

(12) United States Patent
Engel

(10) Patent No.: US 7,611,257 B2
(45) Date of Patent: Nov. 3, 2009

(54) LIGHTING FIXTURE CLOSING MECHANISM

(75) Inventor: Hartmut S. Engel, Monrepos Strasse 7, 71634 Ludwigsburg (DE)

(73) Assignee: Hartmut S. Engel, Ludwigsburg (DE)

( * ) Notice: Subject to any disclaimer, the term of this patent is extended or adjusted under 35 U.S.C. 154(b) by 113 days.

(21) Appl. No.: 10/584,707

(22) PCT Filed: Nov. 26, 2004

(86) PCT No.: PCT/EP2004/013460

§ 371 (c)(1),
(2), (4) Date: Jun. 27, 2007

(87) PCT Pub. No.: WO2005/066541

PCT Pub. Date: Jul. 21, 2005

(65) Prior Publication Data

US 2007/0279896 A1 Dec. 6, 2007

(30) Foreign Application Priority Data

Dec. 23, 2003 (DE) ..... 103 60 948

(51) Int. Cl.
*F21S 8/02* (2006.01)
*F21V 21/04* (2006.01)
*F21V 21/30* (2006.01)

(52) U.S. Cl. ..... 362/147; 362/364; 362/374

(58) Field of Classification Search ..... 362/147, 362/346, 374, 375, 364; 248/343
See application file for complete search history.

(56) References Cited

U.S. PATENT DOCUMENTS

| | | | | |
|---|---|---|---|---|
| 5,012,395 | A * | 4/1991 | Wettengel et al. | 362/222 |
| 5,335,159 | A * | 8/1994 | Chen et al. | 362/421 |
| 5,682,131 | A * | 10/1997 | Gow | 340/286.11 |
| 6,045,241 | A * | 4/2000 | Pahl | 362/365 |
| 6,053,625 | A * | 4/2000 | Bowker | 362/348 |
| 6,264,348 | B1 * | 7/2001 | Ellis | 362/375 |
| 6,371,621 | B1 | 4/2002 | Le Bel | |
| 6,578,233 | B1 * | 6/2003 | Avila et al. | 16/344 |

FOREIGN PATENT DOCUMENTS

DE 20119022 U1 4/2002

* cited by examiner

*Primary Examiner*—Stephen F. Husar
*Assistant Examiner*—Peggy A. Neils
(74) *Attorney, Agent, or Firm*—Gifford, Krass, Sprinkle, Anderson & Citkowski, P.C.

(57) ABSTRACT

The invention relates to a lighting unit, in particular a lighting fixture for ceilings and/or walls comprising a coupled housing frame (2) and a functional frame (3) which is pivotally mounted with respect to the housing frame. A closing device is provided between the housing and functional frames and consists of a specially shaped wire spring (4) which interacts with the rest reception area (10) of the functional frame (3) and comprises a spring leg (8) interacting with the functional frame (3) in a predefined pivoting area under a preload effect.

9 Claims, 8 Drawing Sheets

LIGHTING FIXTURE CLOSING MECHANISM

CROSS-REFERENCE TO RELATED APPLICATIONS

This application is a National Stage of International Application No. PCT/EP2004/013460, filed Nov. 26, 2004, and which claims the benefit of DE 103 60 948.2, filed Dec. 23, 2003. The disclosures of the above applications are incorporated herein by reference.

FIELD

The invention relates to a lamp, in particular to a built-in lamp for ceilings and/or walls, comprising a built-in housing designed to receive an illuminant, reflector and associated mechanical and electrical or electronic components, a housing frame couplable to the housing and to a functional frame supported in an outwardly pivotal manner with respect to the housing frame, and also a closing arrangement active between the housing frame and the functional frame.

BACKGROUND

The statements in this section merely provide background information related to the present disclosure and may not constitute prior art.

With built-in lamps provided with a cover plate, it is known to fasten the cover frame holding the cover plate to the housing via a screw connection, bayonet connection or snap and latch connection so as to be able to change the illuminant or carry out a cleaning procedure after releasing the corresponding connection.

SUMMARY

It is the object of the present invention to develop the closing arrangement between the housing frame and the functional frame in a cost-favorable manner with a built-in lamp of the initially named kind such that, on the one hand, a comfortable change of the illuminant is possible without tools and, on the other hand, the long-term functional capability of the closing arrangement is also ensured with respect to the thermal strains which occur.

This object is essentially satisfied in accordance with the invention in that the closing arrangement consists of at least one wire spring with a fixing region, a spring section which adjoins the fixing region in an angled manner at a side and whose end region is made as a bolt element (5) and cooperates with a latch receiver in the functional frame as well as of a spring limb which adjoins the fixing region at the other side and cooperates with the functional frame over a presettable pivoting range.

In this connection, the latch receiver in the functional frame preferably consists of a spring member with an ingoing slider and an outgoing slider and a latch position provided therebetween, with the locking and unlocking of the preferably pin-shaped bolt element taking place by exertion of pressure onto the functional frame in its direction of opening.

Accordingly, in accordance with the invention, a "push-push" closing arrangement is created, in particular for oblong or square downlights, in which the especially designed wire spring has at least one dual function in that it cooperates with the slider of the latch receiver, on the one hand, and exerts a bias force onto the functional frame, on the other hand, which is required as a counter-force for the operating procedure and which moves the functional frame in a compulsory manner into an outwardly pivoting position on opening.

It is furthermore of substantial importance that the closing arrangement in accordance with the invention is practically integrated into the overall structure in a completely covered manner and that thereby any irritating shadow formation can be avoided and that any problems with respect to the thermal strain capability are precluded, whereby the complete functional capability of the closing arrangement in long-term operation is ensured.

The housing frame is preferably received in the housing in a shape matched manner and the wire spring is arranged with its fixing region and the spring section bearing the bolt element in a cut-out at the outside of the housing frame which is covered by the wall of the housing while defining the fixing region.

A captive fixing of the wire spring together with a precise positioning is achieved by a simple clipping of the wire spring into the corresponding recess of the housing frame and the subsequent joining together of the housing and the housing frame.

The desired exertion of a bias onto the functional frame in its direction of pivoting open is achieved in that the connection region of the wire spring engages over the housing frame and the spring limb adjoining the connection region and disposed at the frame inner side is arranged in the pivot path of the functional frame, whereby the desired spring charge on the functional frame results.

A heat-resistant plastic sleeve is preferably placed onto the angled end region of the spring limb forming the pin-shaped bolt element.

This sleeve, preferably provided with a flange at its end remote from the closed end, ensures a low-friction and noise-free guidance of the bolt element in the latch receiver and contributes to an operation-friendly manner of functioning.

In accordance with an embodiment of the pivot joints required for the pivoting of the functional frame, which is expedient, but does not restrict the present invention, the former respectively consist of a plug-in spigot received in a passage bore of the housing frame and extending into a recess of the functional frame, with the plug-in spigot being held in its position by an elastically resilient region of the sheet steel housing preferably lasered free. In this manner, the functional frame can be simply clipped in and also fully removed for cleaning.

To achieve a dustproof closing, a peripheral seal held in the housing frame is preferably provided which the functional frame contacts in the inwardly pivoted and latched position, in particular under bias.

The functional frame itself is preferably made as a bearer of a reflector or part reflector and can carry at least one light permeable cover plate and/or scattering plate. Irrespective of the respective design of the functional frame, it is ensured in this connection that a free and unimpeded access to the respective illuminant is ensured in the pivoted open state.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
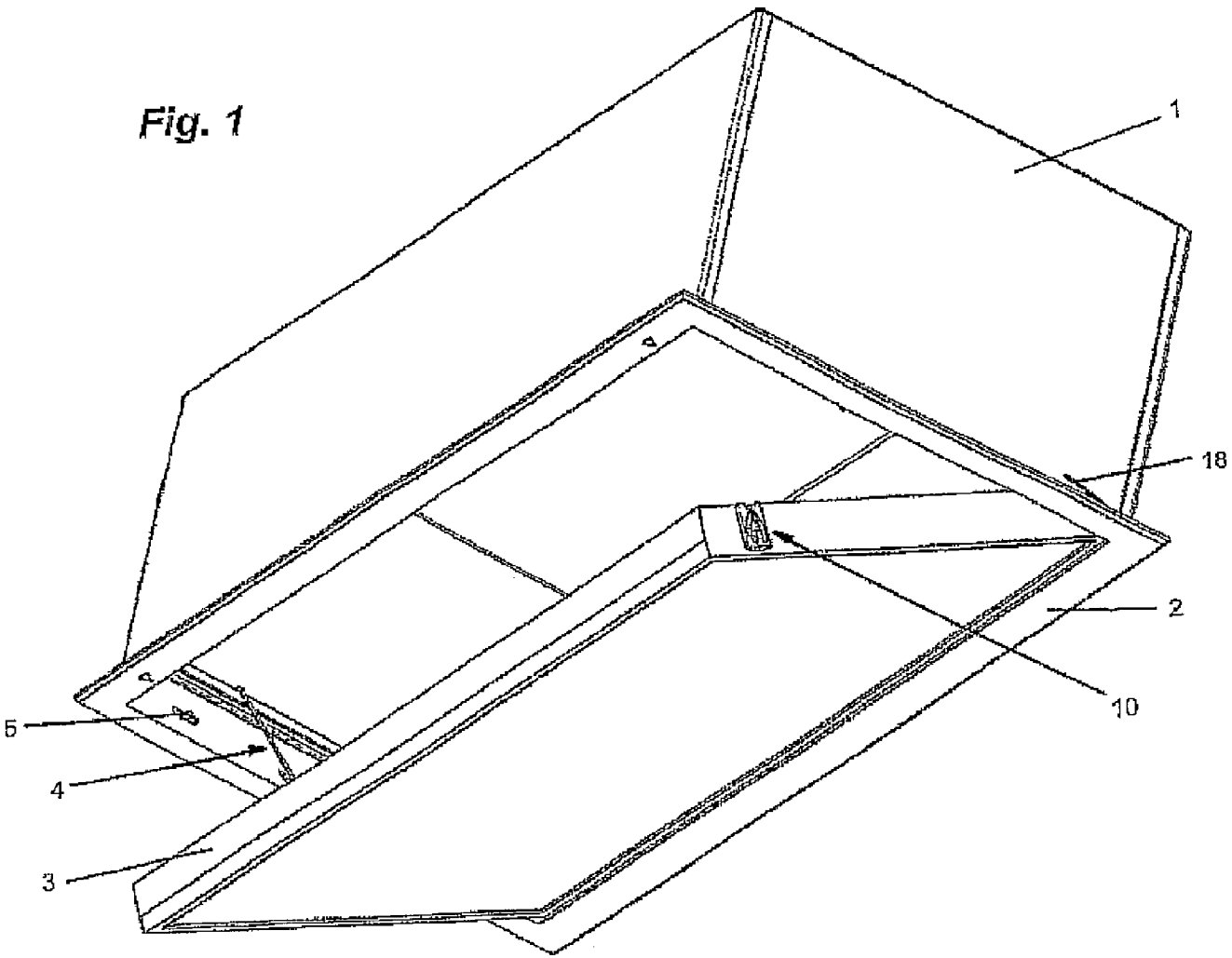
FIG. 1 is a schematic perspective illustration of a downlight with an oblong housing in the partly opened state.

The following description is merely exemplary in nature and is not intended to limit the present disclosure, application, or uses. It should be understood that throughout the drawings, corresponding reference numerals indicate like or corresponding parts and features.

FIG. 1 shows a rectangular housing 1 which preferably consists of sheet steel and into which a housing frame 2 is clipped at which a functional frame or reflector frame 3 is pivotally supported. A closing arrangement is provided between the housing frame 2 and the functional frame 3 which comprises a wire spring 4 which cooperates via a bolt element 5 formed at it with a latch receiver 10 which is integrated into the functional frame 3 in a flush manner.

The closing arrangement is functionally designed as a "push-push" mechanism, i.e. the pivotally supported functional frame 3 is latched in the closed position by pressing in the closing direction relative to the housing frame 2, whereas it is released from the latched position by exertion of a further pressure in the closing direction and can be pivoted open supported by spring action.

Figure 2:
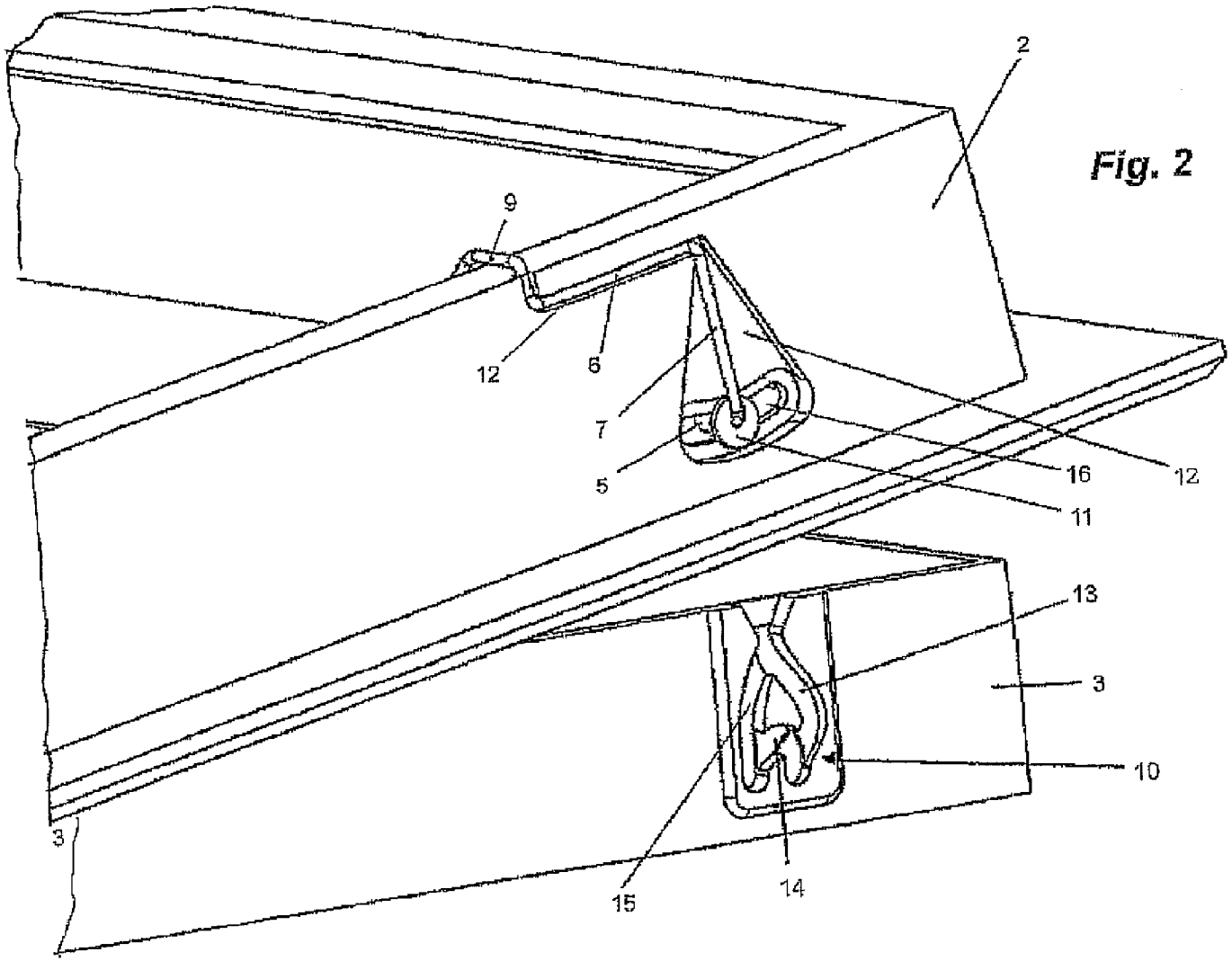
FIG. 2 is a detailed view of the downlight of FIG. 1 with the important elements of the closing arrangement.

FIG. 2 shows the housing frame 2, preferably made as an aluminum die cast frame, in connection with the partly opened functional frame 3 with the housing removed.

The housing frame 2 is provided with an especially shaped cut-out 12 for the reception of the wire spring 4 of which the fixing region 6, the spring section 7 and the connection region 9 can be seen. The fixing region 6 is substantially arranged in a shape matched manner in a correspondingly adapted region of the recess 12, whereas the spring section 7, which bears the bolt element 5, is arranged in an extended region of the cut-out 12 which permits a pivoting of this spring section to the degree it is required by the necessary movements of the bolt element 5 in the associated latch receiver 10.

The connection region 9 of the wire spring engages over the housing frame 2 and extends into the inner region of the housing frame.

The housing frame 2 is furthermore provided with a curved guide slit 16 through which the bolt element 5 inwardly extends. The bolt element 5 is formed by the end of the wire spring which is bent from the spring section at right angles and onto which a heat-resistant plastic sleeve 11 with a rear abutment and guidance flange is placed.

The latch receiver 10 is arranged in a shape matched and outwardly flush manner in a cut-out provided in the functional frame 3. The latch receiver 10 represents a finished part which can be inserted into the corresponding recess, which cooperates with the bolt element 5 and has an ingoing slider 13, a latch position 14 and an outgoing slider 15 for its reception. The latch receiver 10 with its sliders 13, 15 and the latch position 14 can preferably also be cast on directly i.e. be shaped and manufactured integrally as part of the molding process of the functional frame.

Figure 3:
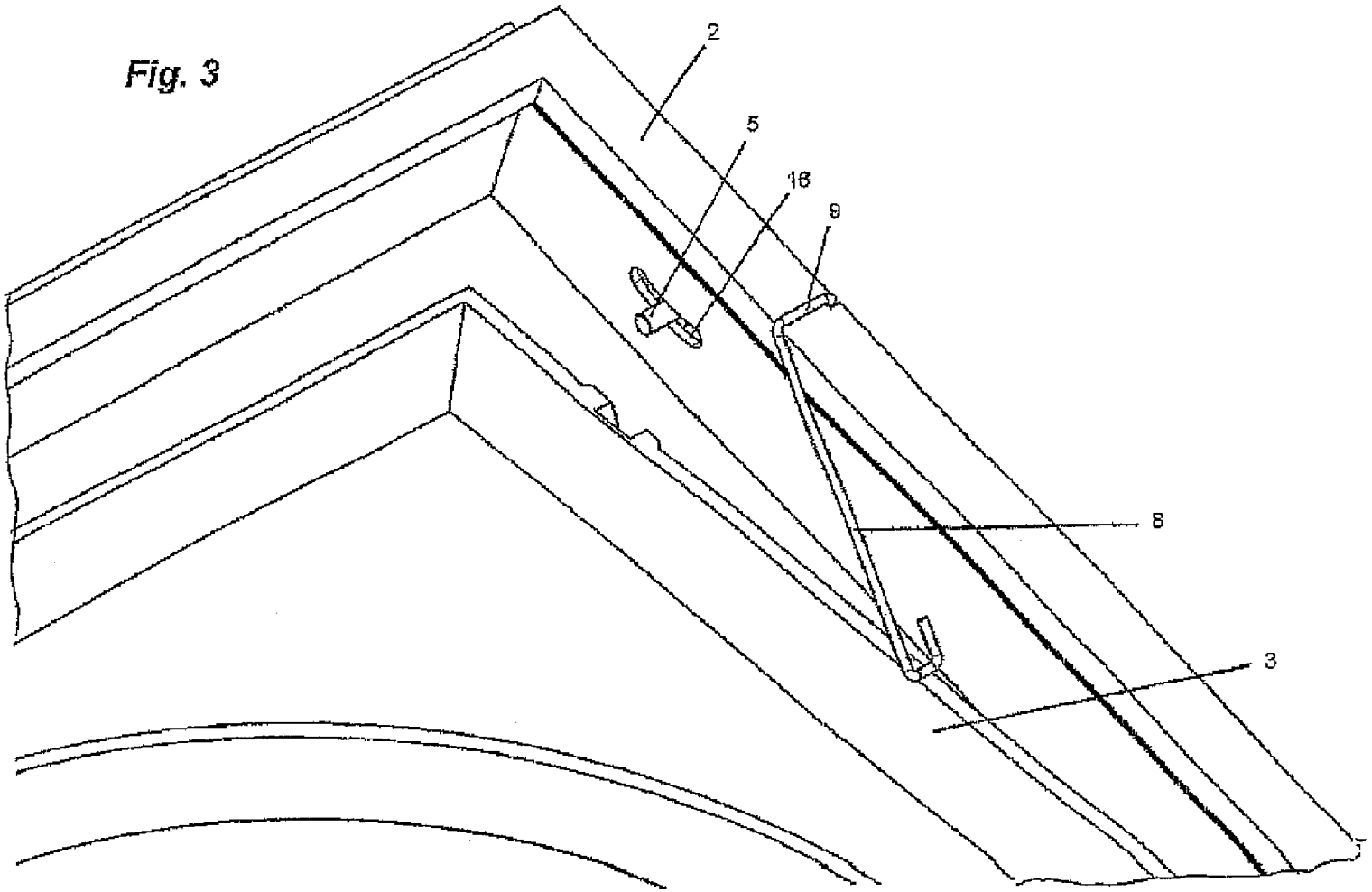
FIG. 3 is a further perspective part view of the downlight of FIG. 1 in a part open position effected by spring force.

FIG. 3 shows a perspective inner view of the housing frame 2 and the functional frame 3 corresponding to the representation in FIG. 2.

In addition to the bolt element 5 which extends inwardly through the guide slit 16 and is formed by the one end of the wire spring, the other end of the wire spring disposed at the frame inner side can be seen in the form of the spring limb 8 adjoining the connection region 9. This spring limb 8 acts as a bias spring with respect to the functional frame 3 and engages into a presettable pivot region of the functional frame 3 at its inside end face. In this manner, the functional frame 3 is always brought into the compulsory open position shown in FIG. 3 on a release of the closing arrangement. When the functional frame 3 is closed and also when the closing arrangement is actuated, the spring limb 8 generates the counter forces desired or needed in this process.

Figure 4:
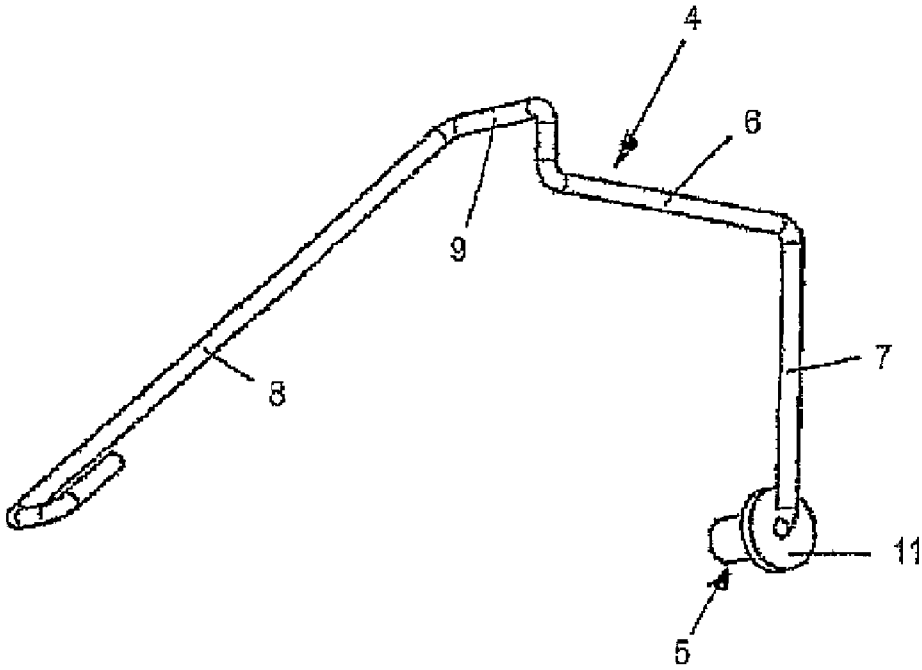
FIG. 4 is a perspective representation of the wire spring used for the closing arrangement.

The multifunctional spring 4 provided in accordance with the invention is shown perspectively in FIG. 4. There can be seen in this connection the spring limb 8 which is disposed at the frame inner side and is made angled, in particular in U shape, at its free end to ensure a good and reliably functioning contact with the functional frame 3 as well as the connection region 9 which the fixing region 6 adjoins. The spring section 7 whose end angled at right angles forms the bolt element 5 extends at a right angle to the fixing region 6. The sleeve element 11 of a plastic material, e.g. Teflon, which is placed onto the spring end, can also be seen in this representation.

Figure 5:
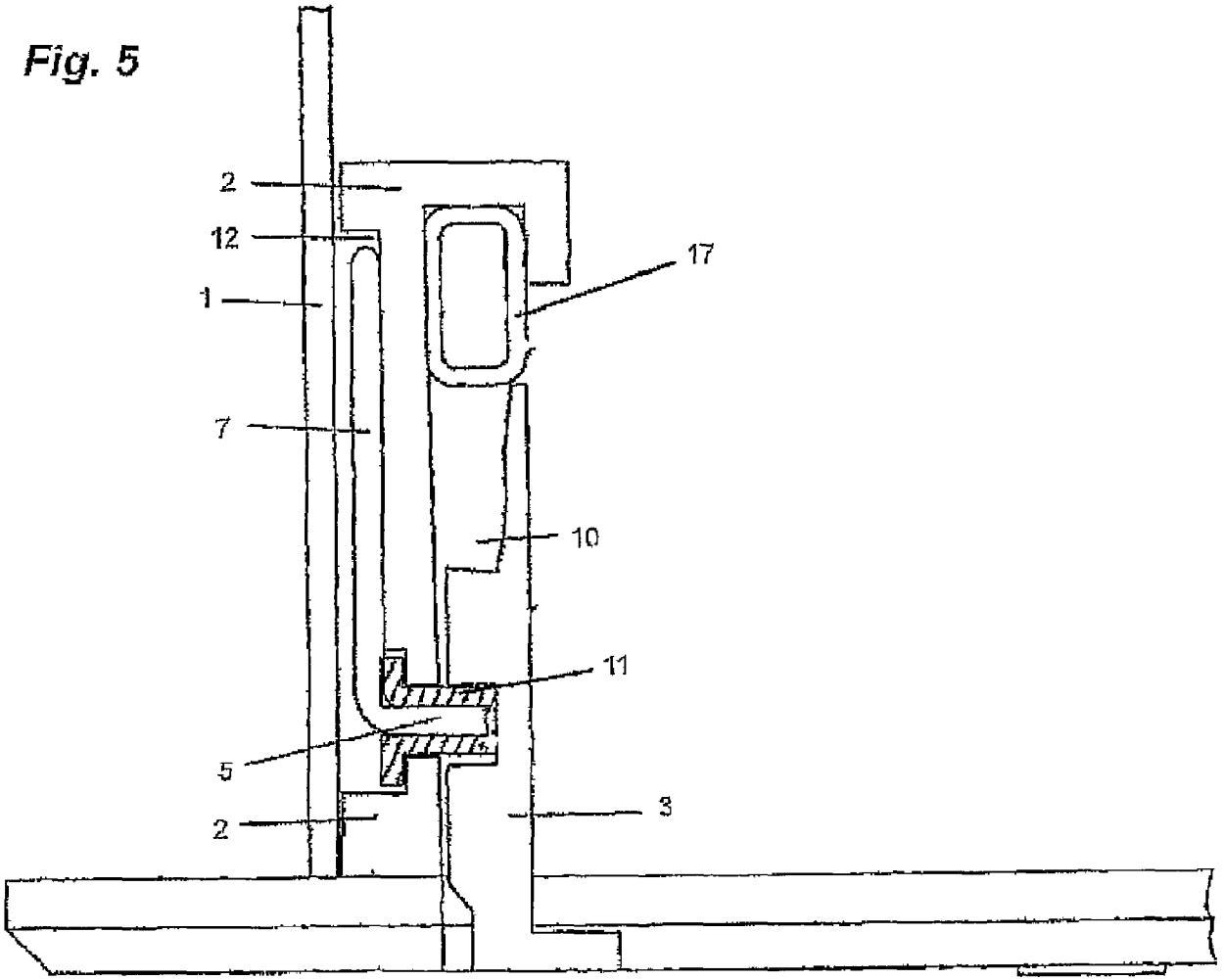
FIG. 5 is a partly sectional representation of the downlight of FIG. 1 in the closed state.

The partly sectional representation of FIG. 5 shows the housing 1 coupled to the housing frame 2, in particular via snap and latch connections, with an inwardly pivoted functional frame 3 located in the unlatched position. In this latched position, the functional frame 3 contacts a peripheral housing seal 17, whereby a dustproof closure is achieved. The housing seal 17 is made such that it can be compressed by the functional frame 3 for the operation of the "push-push" latching to the required degree, e.g. by approximately 3 to 4 millimeters.

In the latched position shown, the latching element 5 bearing the plastic sleeve 11 is in engagement with the latch receiver 10. The positioning of the spring section 7 in the cut-out 12 of the housing frame 2 which is already shown in detail in FIG. 2 and in which the wire spring is held by the housing clipped to the housing frame 2 can also be recognized in this representation.

Figure 6:
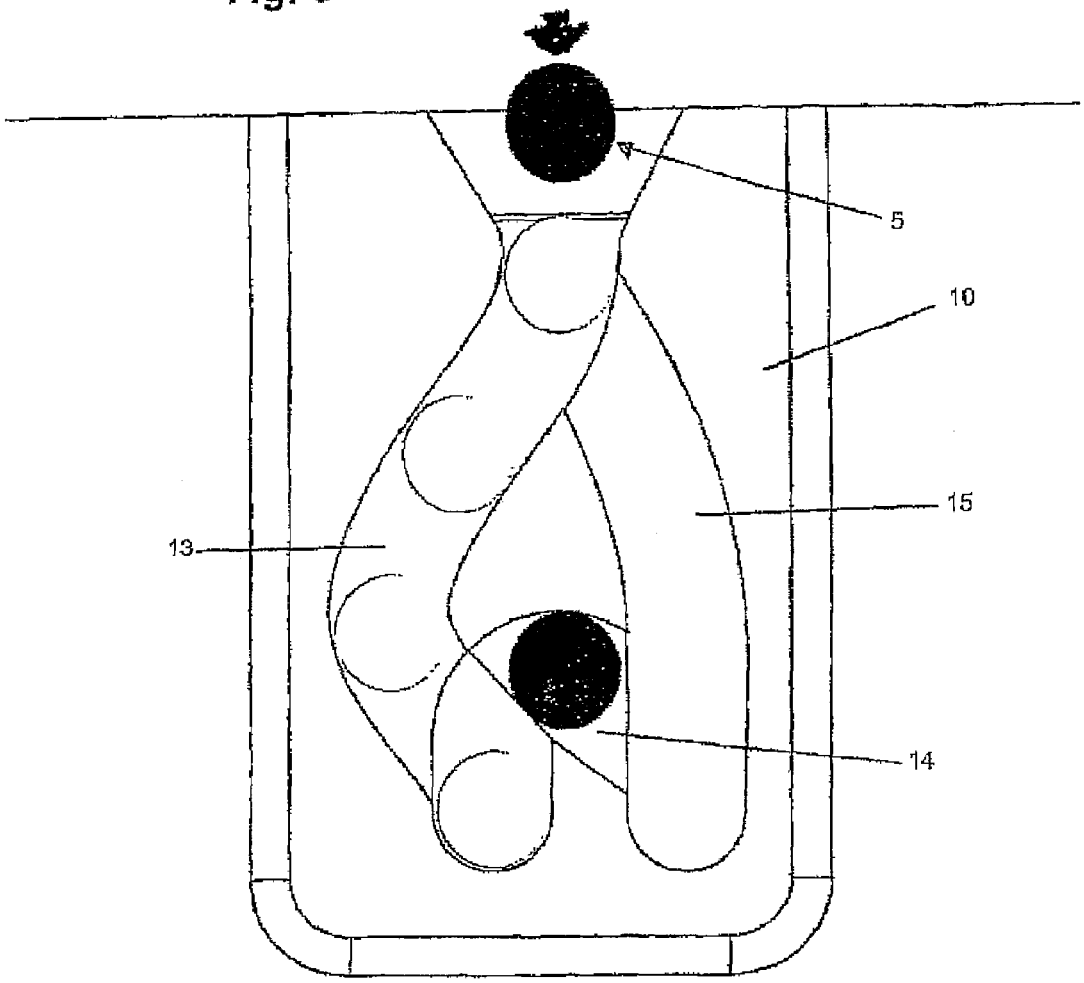
FIGS. 6 and 7 are schematic representations of the latch receiver for the explanation of the "push-push" closing mechanism.
Figure 7:
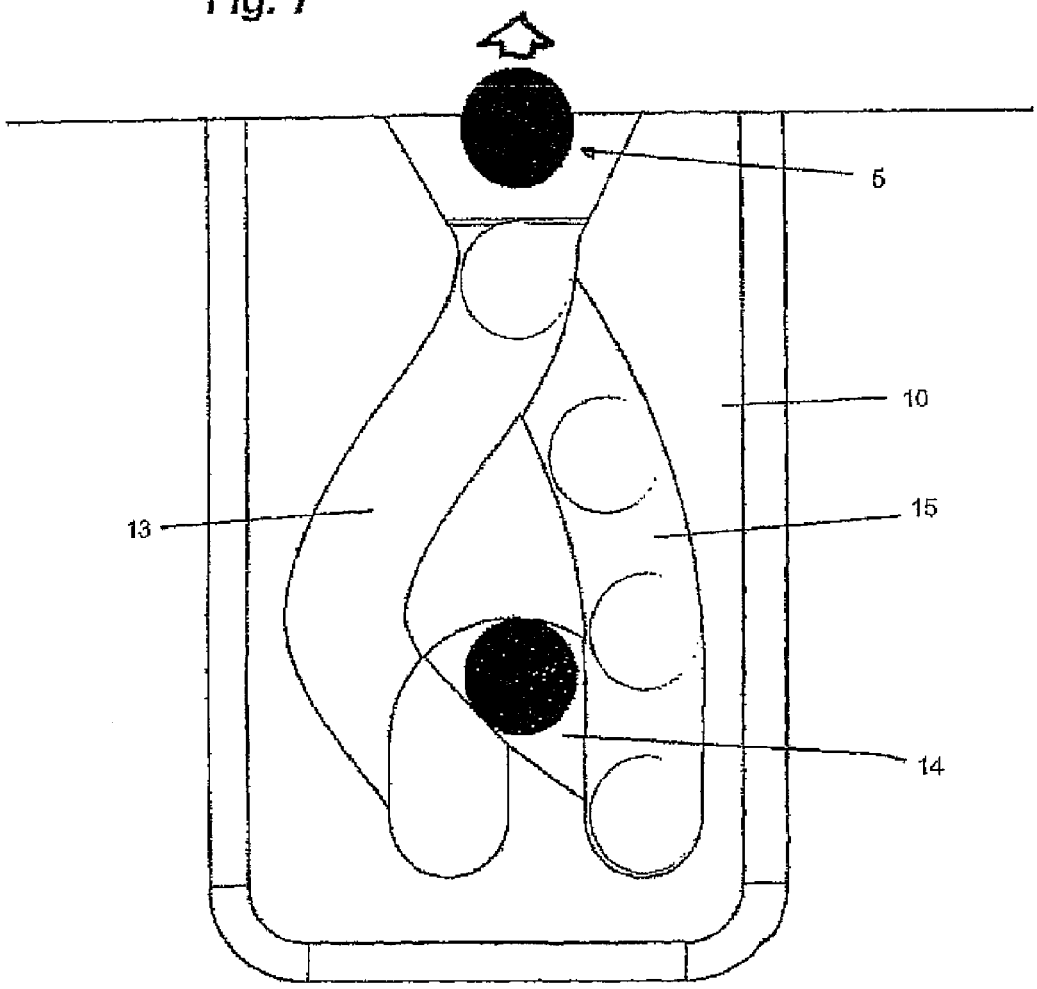

The basic functions of the latch receiver 10 already shown in a specific embodiment in FIG. 1 in the form of a push-push mechanism are shown in FIGS. 6 and 7. Both Figures each show the ingoing slider 13, the latch position 14 for the bolt element 5 and the outgoing slider 15.

When the functional frame 3 is closed, the bolt element 5 moves into the ingoing slider 13 and springs into the latch position 14 in the region of the lower end of the resiliently made unit, where the bolt element 5 is fixed and held in a shape matched manner at a corresponding radius. The functional frame 3 is then located in its preset closed position and is precisely positioned in it.

If—in accordance with the representation in FIG. 7—the functional frame 3 is again pressed in the closing direction, the bolt element 5 springs out of the position still shown in FIG. 7 into the lowest position of the outgoing slider 15 and can then move outwardly by the outgoing slider 15 due to the action of the wire spring 4, with the functional frame 3 being moved in a compulsory manner by the wire spring 4 into the compulsory open position shown in FIG. 3.

The described function accordingly has the result that the closing and opening procedure can be carried out without any use of a tool by a simple exertion of pressure onto the functional frame, with the functional frame being positioned flush with the housing frame 2 in the slider of the latch receiver 10 by the latching procedure in the case of the closing of the functional frame, whereas the bolt element 5 is released and the functional frame 3 is pivoted outward in the opening procedure after a simple pressing onto this functional frame. It is thus ensured that a lamp change can be realized without a tool in an exceptionally easy manner.

Figure 8:
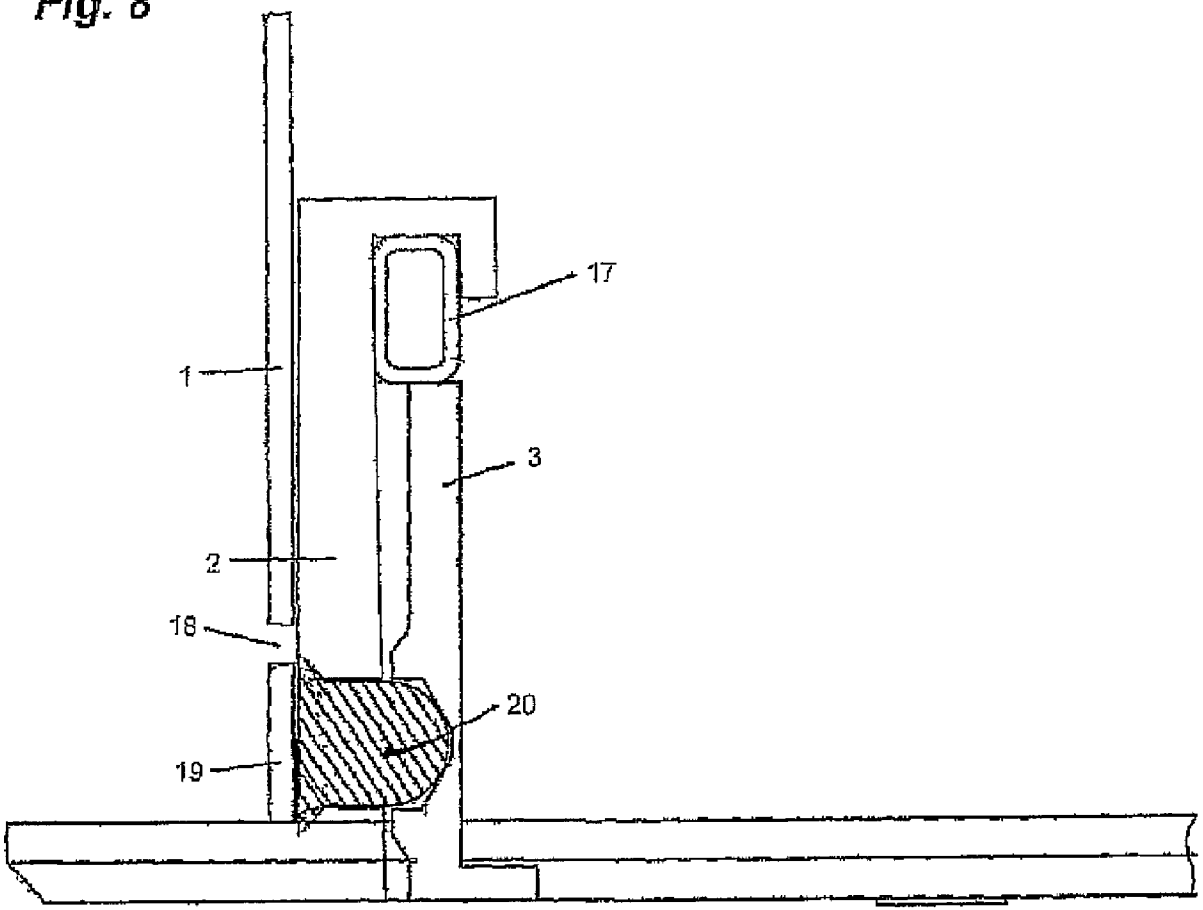
FIG. 8 is a partly sectional representation of the downlight of FIG. 1 for the explanation of an embodiment of a pivot axle realization.

Although the respectively required pivot axle 4 on the functional frame 3 can be realized in various manners, a particularly advantageous aspect of this pivot axle can be realized in the manner shown in FIG. 8. For this purpose, a pivot joint is in each case received in a passage bore of the housing frame 2 and a plug-in spigot 20 extending into a recess 21 of the functional frame 3 is formed, with the plug-in spigot 20 being held in its position by an elastically resilient region 19 of the housing. The elastic region 19 of the housing 1, which preferably consists of spring steel, is achieved by a slit 18 in the housing 1 which is already shown in FIG. 1 and is, for example, lasered free. The pivot axle realization shown in FIG. 8 also above all has the advantage, in addition to the simplicity and the favorable price thus achieved, that in this aspect the functional frame 3 can be very simply clipped into the housing frame 2 or can also be fully removed for cleaning purposes.

The description of the invention is merely exemplary in nature and, thus, variations that do not depart from the gist of the invention are intended to be within the scope of the invention. Such variations are not to be regarded as a departure from the spirit and scope of the invention.

REFERENCE NUMERAL LIST

1 housing (sheet steel)
2 housing frame
3 functional frame (reflector frame)
4 wire spring
5 bolt element
6 fixing region
7 spring section
8 spring limb
9 connection region
10 latch receiver
11 sleeve
12 cut-out
13 ingoing slider
14 latch position
15 outgoing slider
16 guide slit
17 housing seal
18 slit
19 spring region
20 plug-in spigot
21 recess

What is claimed is:

1. A lamp, in particular a built-in lamp for ceilings and/or walls, comprising:

a built-in housing (1) designed to receive an illuminant, reflector and associated mechanical and electrical or electronic components, a housing frame (2) couplable to the housing (1) and a functional frame (3) supported in an outwardly pivotal manner with respect to the housing frame (2), and a closing arrangement active between the housing frame (2) and the functional frame (3), wherein the closing arrangement comprises at least one wire spring (4) with a fixing region (6), a spring section (7) which adjoins the fixing region (6) in an angled manner at a side and whose end region is made as a bolt element (5) and cooperates with a latch receiver (10) in the functional frame (3) as well as of a spring limb (8) which adjoins the fixing region (6) at the other side and cooperates with the functional frame (3) over a presettable pivoting range and the bolt element (5) is formed by an angled end region of the spring section (7) extending through a guide slit (16) in the housing frame (2); and in that the associated latch receiver (10) in the functional flame (3) consists of a spring member with an ingoing slider (13) and an outgoing slider (15) and a latch position (14) provided therebetween, with the latching and unlatching of the pin-shaped bolt element (5) taking place by exertion of pressure onto the functional frame in its closing direction.

2. A lamp in accordance with claim 1, wherein the housing frame (2) is received in the housing (1) in a shape matched manner and the wire spring (4) is arranged with its fixing region (6) and the spring section (7) bearing the bolt element (5) in a cut-out (12) at the outside of the housing frame (2) which is covered by the wall of the housing (1) while defining the fixing region (6).

3. A lamp in accordance with claim 2, wherein the connection region (9) of the wire spring (4) engages over the housing frame (2) and the spring limb (8) adjoining the connection region (9) and disposed at the frame inner side is disposed in the pivot path of the functional frame (2) and acts resiliently on it in the opening direction.

4. A lamp in accordance with claim 1, wherein the spring section (7) is pivotal in the recess (12) in dependence on the movement of the bolt element (5) which extends inwardly through the guide slit (16) through the housing frame (2) and cooperates with the latch receiver (10) provided in the functional frame (2) with the functional frame (3) pivoted inwardly.

5. A lamp in accordance with claim 1, wherein a heat-resistant plastic sleeve (11) is attached to the angled end region of the spring limb (7).

6. A lamp in accordance with claim 1, wherein the pivot joints allowing the pivoting of the functional frame (3) in each case comprise a plug-in spigot (20) received in a passage bore of the housing frame (2) and extending into a recess (21) of the functional frame (3), with the plug-in spigot (20) being held in its position by an elastic resilient region (19) of the housing (1).

7. A lamp in accordance with claim 1, wherein the functional frame (3) contacts a peripheral seal (17) held in the housing frame (2), in particular under bias, in the inwardly pivoted and latched position.

8. A lamp in accordance with claim 1, wherein the functional frame (3) is made as a bearer of a reflector or of a part reflector.

9. A lamp in accordance with claim 1, wherein the functional frame (3) bears a light permeable cover plate and/or scattering plate.

* * * * *

UNITED STATES PATENT AND TRADEMARK OFFICE

CERTIFICATE OF CORRECTION

PATENT NO. : 7,611,257 B2
APPLICATION NO. : 10/584707
DATED : November 3, 2009
INVENTOR(S) : Hartmut S. Engel It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 246 days.

Signed and Sealed this

Twelfth Day of October, 2010

David J. Kappos

David J. Kappos
*Director of the United States Patent and Trademark Office*